US007302957B2

(12) United States Patent
Ross

(10) Patent No.: US 7,302,957 B2
(45) Date of Patent: Dec. 4, 2007

(54) SELF-ERECTING AND COLLAPSIBLE SHADE DEVICE

(76) Inventor: Timmy L. Ross, 2838 W. Morten Ave., Phoenix, AZ (US) 85051

( * ) Notice: Subject to any disclaimer, the term of this patent is extended or adjusted under 35 U.S.C. 154(b) by 559 days.

(21) Appl. No.: 10/855,619

(22) Filed: May 28, 2004

(65) Prior Publication Data

US 2004/0255996 A1 Dec. 23, 2004

Related U.S. Application Data

(60) Provisional application No. 60/479,101, filed on Jun. 17, 2003.

(51) Int. Cl.

| | |
|---|---|
| ***E04H 15/40*** | (2006.01) |
| ***E04H 15/44*** | (2006.01) |
| ***E04H 15/58*** | (2006.01) |
| ***E04H 15/02*** | (2006.01) |
| *A47C 7/62* | (2006.01) |

(52) U.S. Cl. ..... 135/126; 135/128; 135/117; 297/184.15

(58) Field of Classification Search ..... 135/124, 135/125, 126, 128, 136, 137, 120.4; 297/184.15, 297/188.06

See application file for complete search history.

(56) References Cited

U.S. PATENT DOCUMENTS

| | | | | |
|---|---|---|---|---|
| 5,645,096 | A * | 7/1997 | Hazinski et al. | 135/126 |
| 6,109,281 | A * | 8/2000 | Lowenthal | 135/125 |
| 6,109,282 | A * | 8/2000 | Yoon | 135/126 |
| 6,698,827 | B2 | 3/2004 | Le Gette et al. | |
| 7,225,822 | B1 * | 6/2007 | Zheng | 135/126 |
| 2002/0112752 | A1 | 8/2002 | Blakney | |
| 2003/0106577 | A1 | 6/2003 | Martinez | |

* cited by examiner

*Primary Examiner*—David Dunn
*Assistant Examiner*—Danielle Jackson
(74) *Attorney, Agent, or Firm*—Richard C. Litman

(57) ABSTRACT

The self-erecting and collapsible shade device is provided in the form of a portable collapsible shade assembly. The assembly includes a self-erecting and collapsible canopy, a self-erecting and collapsible canopy shade pivotally mountable to the erected canopy, at least two ground stakes, anchor lines and a storage bag for conveniently carrying the components of the assembly. The erected shade assembly may be secured directly to the ground or affixed to an outdoor chair or seat having a backrest. When the storage bag is empty it is usable as a seat cover to protect the clothing of a user seated beneath the assembly from being soiled by the ground. The assembly may also be used as a hunting blind.

13 Claims, 7 Drawing Sheets

SELF-ERECTING AND COLLAPSIBLE SHADE DEVICE

CROSS-REFERENCE TO RELATED APPLICATION

This application claims the benefit of U.S. Provisional Patent Application Ser. No. 60/479,101, filed Jun. 17, 2003.

BACKGROUND OF THE INVENTION

1. Field of the Invention

The present invention relates to sunshades and more particularly to a freestanding self-erecting shade device that is collapsible for convenient transport and storage.

2. Description of the Related Art

Collapsible sunshades for chairs have been the subjects of previous patents. For example, in US 20003/0106577 A1 published Jun. 12, 2003 to Martinez teaches a collapsible sunshade for a chair. The shade is provided in the form of a flexible ring made of spring steel or other spring material. A fine mesh membrane or fabric material is attached to and disposed within the ring. The ring may be moved between an open position for providing shade and a closed position under spring tension for collapsing the shade. The opened shade can be bent and affixed to a chair to cover at least a portion of the seat of the chair. In one form of the Martinez shade, opposite ends of the erected shade are affixed to the arms of the chair to cover the seat portion of the chair. Another version of the Martinez shade has a narrow rear end and a wide front end. The narrow end is affixed to a support band on the back of the chair by fasteners. Cords are provided on the wide end to cinch to the chair so that the shade is bent towards the front of the chair over the seat of the chair in a position permitting a user to sit in the chair. A small fabric pocket may be attached to the shades for carrying small items and a flap or screen is provided in central portion of the shades to allow wind to pass through.

In FIGS. 23-28 of U.S. Pat. No. 6,698,827 B2 issued Mar. 2, 2004 to Le Gette et al., collapsible shades similar in design to the Martinez shade. Gette et al., however, places the ventilation opening on the narrow rear portion of the shades and includes a carry bag for the collapsed shade. The flaps extend away from the perimeter of the flexible band frame and provided with cord and fasteners for securing the shade to the chair. The flaps also provide additional shading.

In Patent Application Publication Number US 2002/0112752 A1 published Aug. 22, 2002 to Blakney a rigid folding canopy frame is supported in a chair bag mounted over the back of the chair. The chair bag includes a fabric pouch stitched thereon. A set of interchangeable canopies including a sunshade hemmed above the line of sight of a person sitting underneath it, a mosquito net of dark mosquito netting and a photography or changing blind having a hole in the line of sight of a person sitting in the chair.

None of the above inventions and patents, taken either singly or in combination, is seen to describe the instant invention as claimed. Thus a self-erecting and collapsible shade device solving the aforementioned problems is desired.

SUMMARY OF THE INVENTION

The self-erecting and collapsible shade device of the present invention is provided in the form of a portable collapsible shade assembly that includes, a self-erecting and collapsible canopy, a self-erecting and collapsible canopy shade pivotally mountable to the erected canopy, at least two ground stakes and anchor lines for securing the canopy against strong winds and a storage bag for conveniently carrying the collapsed canopy, collapsed canopy shade, and other components of the assembly.

The erected shade assembly may be secured directly to the ground or affixed to an outdoor chair or seat having a supported backrest. When the storage bag is empty it can also be used as a seat cover to protect the users clothing from grass stains and soil. The assembly is primarily intended to be used to provide shade out in the open under the sun but may also be used as a hunting blind.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
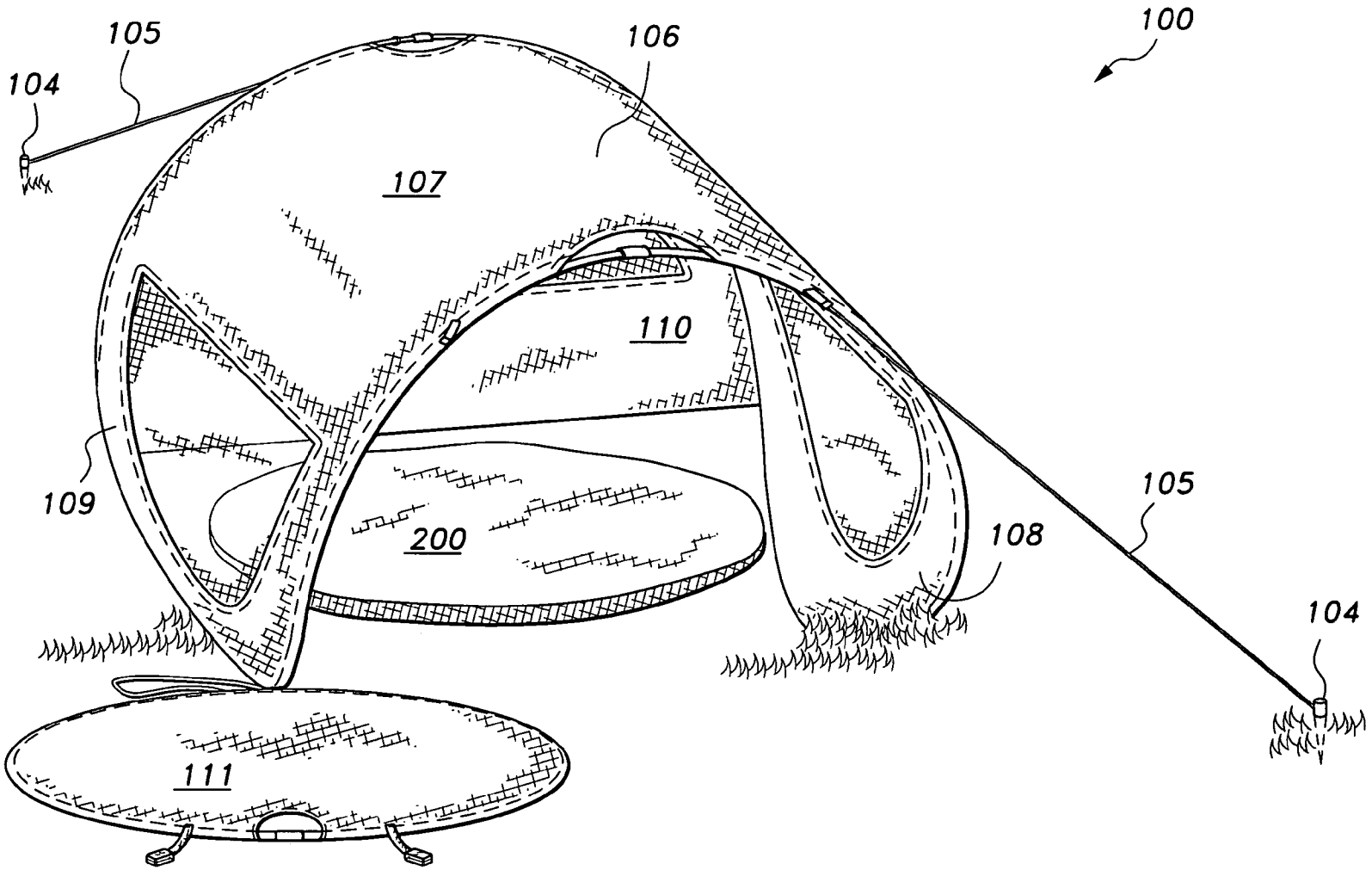
FIG. 1 is an environmental perspective view of the freestanding self-erecting and collapsible shade device according to the present invention.

The present invention is a portable freestanding self-erecting and collapsible shade assembly 100. The erected shade assembly 100 may be secured directly to the ground or affixed to an outdoor chair or seat having a supported backrest. Referring first to FIG. 1, shade assembly 100 includes a storage bag 200, at least two stakes 104, anchor lines 105, a canopy 106 and a canopy shade 111. The canopy 106 is secured to the ground by anchor lines 105. One end of each anchor line 105 is connected to the top section 107 of canopy 106 and secured to the ground at a second end by stakes 104. Storage bag 200 is placed on the ground underneath canopy 106 as a ground cover to be sat upon by a user.

Figure 2:
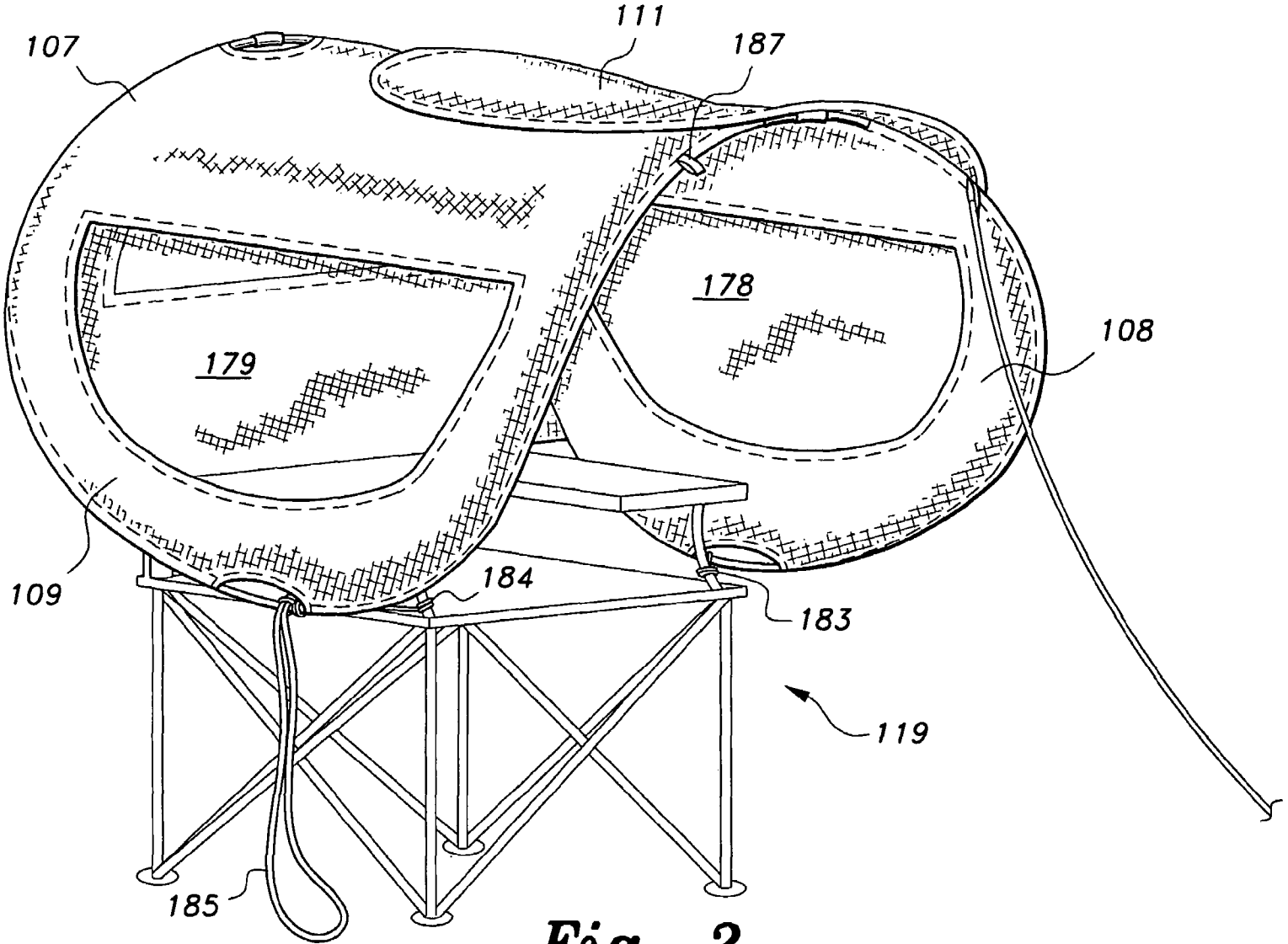
FIG. 2 is a perspective view of the canopy of the shade device according to the present invention mounted upon a chair.
Figure 3:
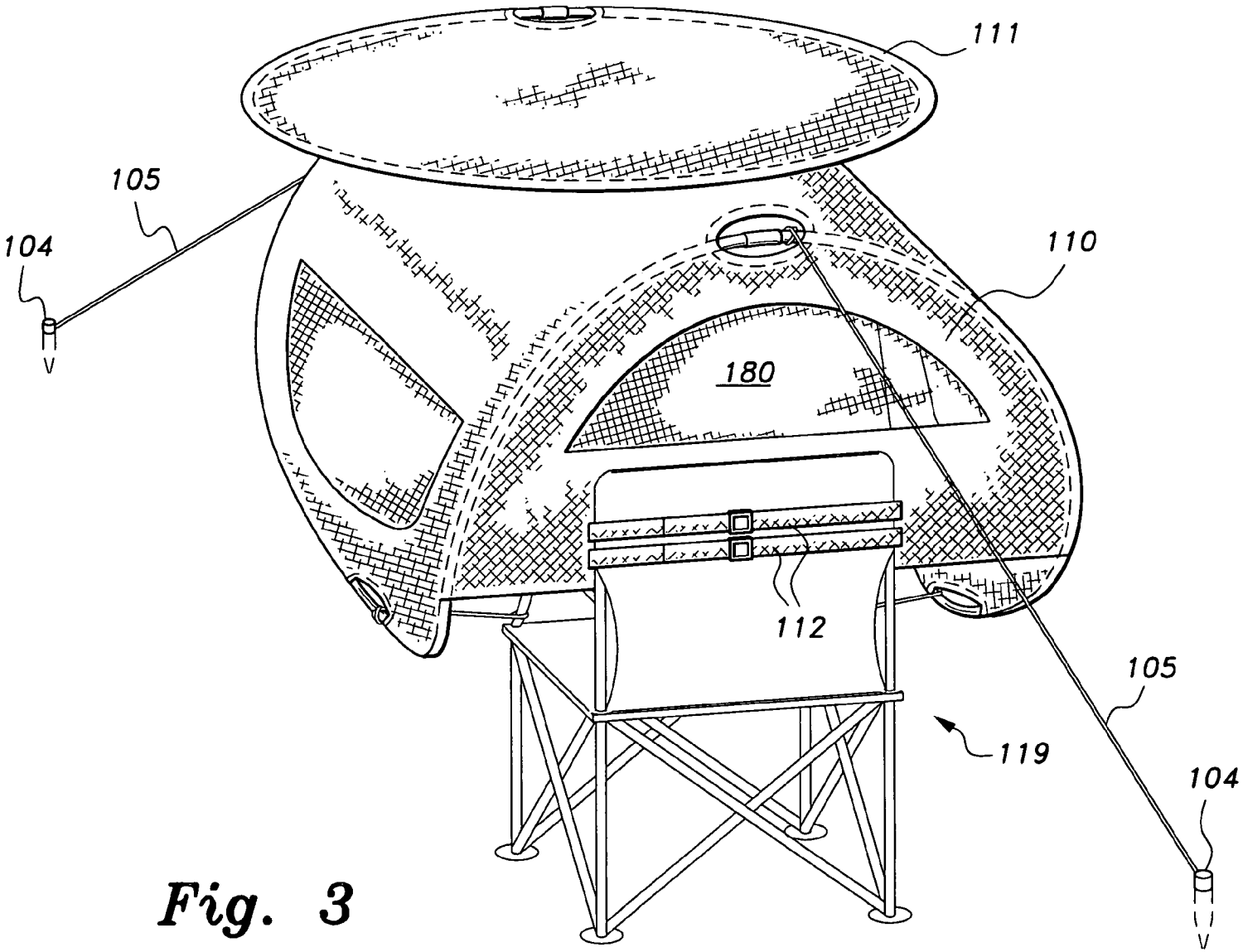
FIG. 3 is a rear perspective view of the canopy of the shade device according to the present invention mounted upon a chair.

In FIGS. 2 and 3, canopy 106 is shown affixed to a chair 119. Canopy shade 111 is shown erected and pivotally attached to the top section 107 of canopy 106 from an open position permitting entry by a user to a closed position providing shade over the front opening of canopy 106. FIG. 3 additionally shows two rear web straps 112 which are used to secure canopy 106 to the backrest of chair 119 or to secure the canopy 106 to the ground with a stake 104.

Figure 4:
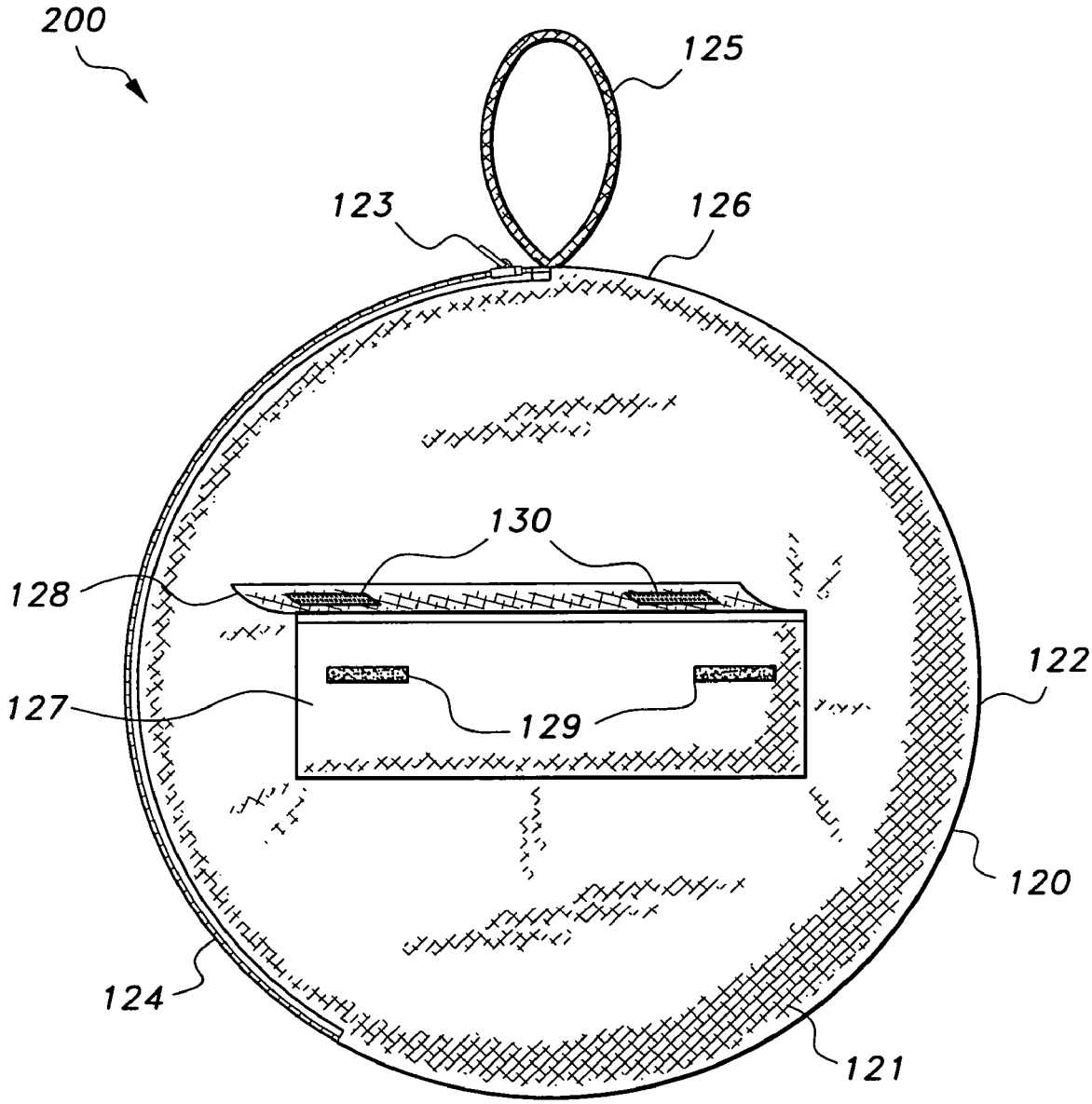
FIG. 4 is a front view of a bag for storing and transporting the canopy shade and canopy of the shade device according to the present invention.

Turning now to FIG. 4, the flexible body 120 of storage bag 200 is shown to be generally circular in shape having a front side 121 and a back side 122. A zipper 123 is provided in the opening 124 of bag body 120. Storage bag 200 is sized to receive the collapsed canopy 106, the collapsed canopy shade 111, the tie-stakes 104 and anchor lines 105. A flexible carry strap 125 is attached to a top edge 126 of bag body 120 and a pocket 127 with closure flap 128 is provided on the front face 121 of the bag body 120. The bag body 120 may be formed from any suitable durable flexible material. Patches 129 of hook and loop fastener material are provided on pocket 127 for releasably engaging patches 130 on the underside of flap 128 so that additional personal items can be removably stored in pocket 127 of bag body 120.

Figure 5:
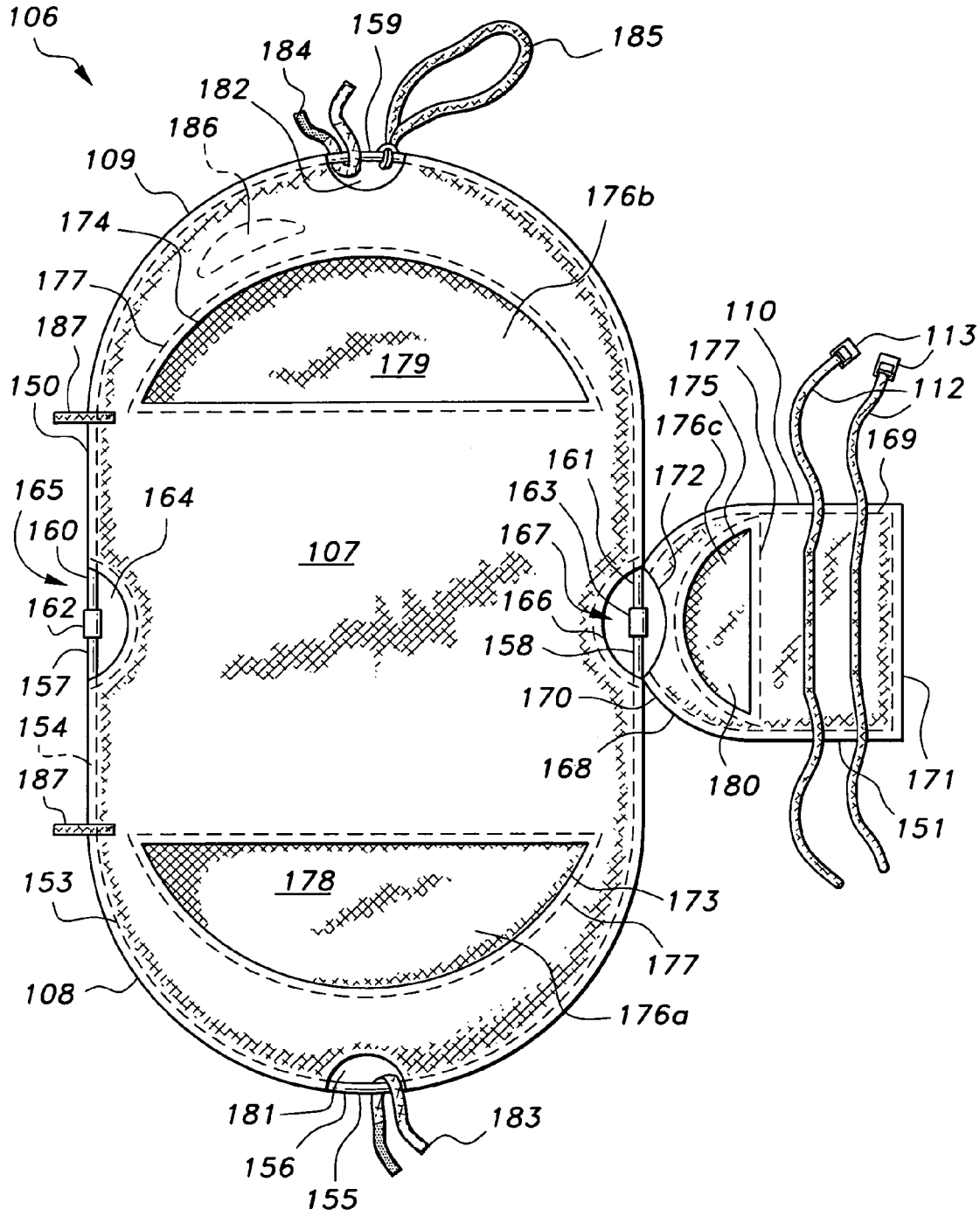
FIG. 5 is a top plan view of the canopy the shade device according to the present invention.

FIG. 5 shows that the canopy 106 is provided in the form of a generally oval section 150 and a U-shaped section 151. Stitching 169 along the side edges 168 secures U-shaped section 151 to a rear edge of oval section 150 to form the rear section 110 of canopy 106.

Oval section 150 further includes a first frame access openings 164 centrally located along the front edge of top section 107, a second frame access opening 166 centrally located along the rear edge of top section 107, a first frame support opening 181 centrally located along the bottom edge and a second frame support opening 182 centrally located along the top edge (as best shown in FIG. 5). Oval section 150 forms the first side section 108, top section 107 and second side section 109 of canopy 106. Both sections 150, 151 are both formed of a pliable material preferably Rip Stop Nylon, but can be made of other suitably pliable material as well.

Still referring to FIG. 5, oval section 150 is folded along the edge and stitching 153 is provided to form a frame-receiving channel 154 around the periphery of the oval section 150. A first vent opening 173 is formed in first side section 108, a second vent opening 174 is provided in second side section 109 and a third vent opening 175 is provided in rear section 110.

Flexible mesh panels 176A-C are affixed by stitching 177 over vent openings 173-175, respectively to form a first ventilation window 178 in first side section 108, a second ventilation window 179 in second side section 109 and a third ventilation window 180 in rear section 110. Ventilation windows 178-180 are provided to aid in airflow circulation.

The flexible mesh panels 176 A-C are preferably provided in the form of green mosquito netting but may be formed of any suitable netting. The ventilation windows 178, 179 and 180 are depicted in the drawing figures in the form of a half circle but can be provided in any desirable ornamental configuration or shape suitable for appropriate ventilation.

A net storage bag 186 is sewn onto the inner surface of second side surface 109 the canopy 106 for storing personal items of a user, beverages and other refreshments. The bag 186 may be formed with compartments for separating some of the stored items. Bag 186 is mounted so as make the items readily accessible to the user.

Figure 7:
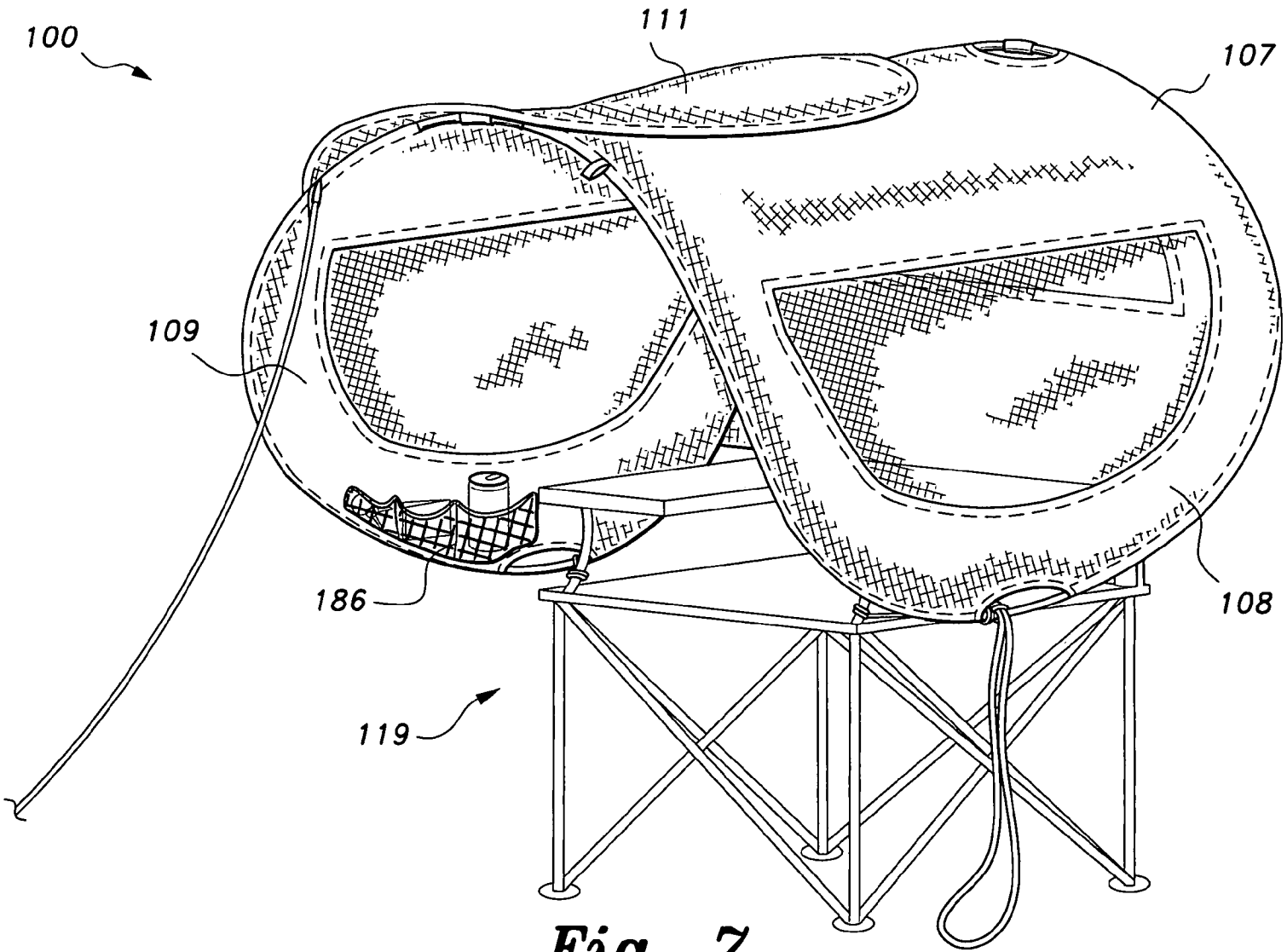
FIG. 7 is a perspective view of the shade device according to the present invention showing a meshed storage bag affixed on the inside of the canopy.

In FIG. 7, the canopy 106 is shown secured to a chair 119. The net storage bag 186 is located adjacent to the arm of the chair 119 for convenient access to the stored items.

On the back side of the rear section 110 as shown in FIGS. 3 and 5, there are two quick release web straps 112 having quick release buckles 113 on one end. Web straps 112 are stitched into the lower part of the rear section 110. The free ends of straps 112 loop around the back of the chair 119. The second end of each strap 112 is passed through buckles 113 to draw straps 112 tightly around the back of chair 119 and secured by the quick release buckles 113 to support the back of the canopy 106.

A resilient flexible frame 155 is inserted into the frame-receiving channel 154 to form the overall arch configuration of the canopy 106 as shown in FIGS. 1-3 and 7. Frame 155 is provided in the form of a first frame rod 156 having a first end 157 and a second end 158 and a second frame rod 159 having a third end 160 and a fourth end 161. Rods 156 and 159 are inserted into frame receiving channel 154 of oval section 150 and secured. First end 157 of rod 156 and third end of rod 159 are fixedly secured together by a ferrule 162. Second end 158 of rod 156 and fourth end 161 of rod 159 are fixedly secured together by a ferrule 163. Rods 156 and 159 of frame 155 are made of any suitable spring-like material; preferably they are ¼ inch solid fiberglass rods held together by ¼ inch ferrules.

A portion of frame rod 159 is accessible through frame support opening 182 and is provided with a double sided hook and loop fastening arm connection strap 184 and an elastic restraining strap 185. Restraining strap 185 is sized to securely retain canopy 106 in a collapsed position for storage in storage bag 200.

A portion of frame rod 156 is accessible through frame support opening 181 and is provided with a double-sided hook and loop fastening arm connection strap 183. The arm connection straps 183 and 184 are connected to the arm support frame or other suitable portion of chair 119 by wrapping the double sided hook and loop fastening arm connection straps 183 and 184 around the arm support frame several times. This provides support for the front of the canopy 106.

Access to sections 165 and 167 of frame 155 is provided through frame access openings 164 and 167, respectively. Sections 165 and 167 of resilient flexible frame 155 are used as handles during the removal and collapse of the canopy 106.

Two tie-down loops 187 are stitched to the front edge of the top section 107 of canopy 106 at approximately 10 O'clock and 2 O'clock position as viewed in FIG. 2. Tie-down loops 187 provide tie downs points for anchor lines 105 in windy conditions or attachment points for canopy shade 111.

Figure 6:
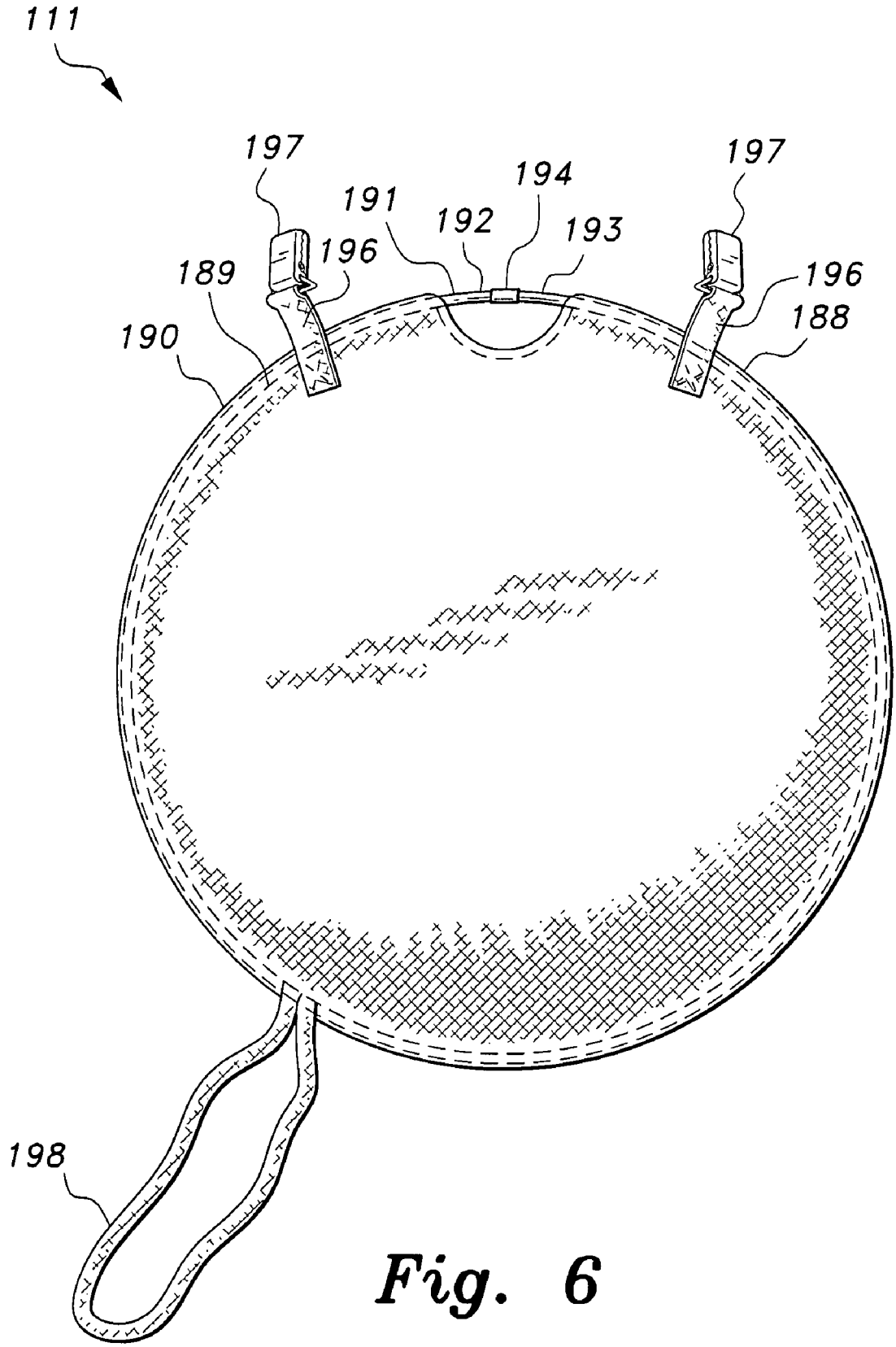
FIG. 6 is a front perspective view of the canopy shade for the canopy of the shade device according to the present invention.

The canopy shade 111 is provided in the form of a generally round shade body 188 formed of a green mosquito netting but can be made of other suitable netting materials as well. The edge of body 188 is folded and secured by stitching 189 to form a shade frame channel 190. A frame in the form of spring-like rod 191 is placed in channel 190 with the ends 192 and 193 secured together by a ferrule 194. Elastic straps 196 are connected to suspender clips 197 and stitched along the edge of the body 188 generally at the 10 O'clock and 2 O'clock position as viewed in FIG. 6. The clips 197 are used to pivotally attach the canopy shade 111 to the tie-down loops 187 on canopy 106. A flexible strap 198 is stitched to body 188 at a location opposite the location of attachment of clips 197.

Shade 111 is collapsible by twisting rod 191 into a figure eight and folding the loops together. Flexible strap 198 is wrapped around the collapsed shade 111 to hold it in the collapsed condition for storage and handling as seen in FIG. 1.

After the canopy 106 has been removed from the storage bag 200, the elastic restraining strap 185 is been removed and the canopy 106 tossed away from the user and any other object the resiliency of the frame 155 causes the canopy to self-erect.

Start installation by placing the bottom 171 of the rear section 110 over the arms of the chair and then placing the quick release web strap 112 around back of chair 119.

To complete installation lift the front of the canopy 106 and attach arm connection straps 183 and 184 to the arms or other front portions of the chair, then return to back of chair 119 and tightened quick release web strap 112 with buckles 113. Both quick release straps 112 should be taut to support the back of the canopy 106 upon the chair 119. Removal is opposite of installation.

After removal of canopy 106 (when used on a chair), place the canopy 106 on the ground with the quick release web straps 112 facing to your left.

Grasp resilient flexible frame section 165 with one hand and frame section 167 with the other.

The resilient flexible frame sections 165 and 167 are brought together.

While holding resilient flexible flame sections 165 and 167 together with left hand, rotate the canopy 106 sideways so that the elastic restraining strap 185 is on the bottom and the quick release web straps 112 are facing away from you.

Place your right foot lightly on the edge of the bottom semi circle for stability.

With your right hand fold the top semi circle down past the vertical position and lightly apply downward pressure with your left hand while still holding resilient flexible frame sections 165 and 167 to prevent canopy 106 from unfolding.

Grasp the semi circle furthest away from you with your right hand while still holding semi circle closest to you with your left hand.

Press each semi circle down and toward the center to collapse the canopy 106.

Once the canopy 106 has collapsed ensure all straps except for the elastic restraining strap 185 are stored inside the collapsed canopy 106.

Grasp the collapsed canopy 106 with one hand and with the other hand stretch the elastic restraining strap 185 over the canopy 106 to prevent it from unfolding. The canopy 106 is now ready for storage in supplied storage bag 200.

All straps may be mechanical or stretch material.

It is to be understood that the present invention is not limited to the embodiments described above, but encompasses any and all embodiments within the scope of the following claims.

I claim:

1. A freestanding self-erecting and collapsible shade device, comprising:

a self-erecting and collapsible canopy, said canopy having a generally oval section and a U-shaped section, wherein said oval section forms a first side section, top section and a second side section of said canopy and said U-shaped section is secured to a rear edge of said oval section to form a rear section of said canopy, further wherein said oval section includes a frame receiving channel formed along the peripheral edge thereof and including a flexible frame secured within said channel;

a first ventilation window formed in said first side section;

a second ventilation window formed in said second side section;

a third ventilation window formed in said rear section;

a self-erecting and collapsible canopy shade removably attachable to said canopy;

at least two ground stakes and anchor lines for securing the canopy against strong winds, a pair of tie-down loops stitched adjacent to a front edge of said top section of said canopy to provide tie downs points for said anchor lines; and a storage bag for conveniently carrying the collapsed canopy, stakes and lines.

2. The shade device according to claim 1, wherein said ventilation windows include a flexible mesh material.

3. The shade device according to claim 2, wherein said flexible mesh material is mosquito netting.

4. The shade device of claim 1, wherein:

said canopy shade is provided in the form of a generally round shade body formed of mosquito netting having a shade frame channel stitched along the periphery of said shade body;

a flexible frame in the form of a rod placed in said frame channel with the ends of said rod secured together by a ferrule;

a pair of elastic straps stitched along the edge of said body having suspender clips attached to a distal end thereof.

5. A freestanding self-erecting and collapsible shade device, comprising:

a self-erecting and collapsible canopy, said canopy having a generally oval section and a U-shaped section, wherein said oval section forms a first side section, top section and a second side section of said canopy and said U-shaped section is secured to a rear edge of said oval section to form a rear section of said canopy, wherein said oval section includes a frame receiving channel formed along the peripheral edge thereof; said frame further including:

a flexible frame secured within said channel;

further wherein said frame is provided in the form of a first frame rod having a first end and a second end and a second frame rod having a third end and a fourth end, said rods being inserted into said frame receiving channel of said oval section;

said first end of said first frame rod and said third end of said second rod being fixedly secured together by a first ferrule;

said second end of said first rod and said fourth end of said second rod being fixedly secured together by a second ferrule;

a first frame support opening provided in said first side section of said canopy and a second frame support opening provided in said second side section of said canopy;

a portion of said first frame rod being accessible through said first frame support opening;

a portion of said second frame rod being accessible through said second frame support opening, at least two ground stakes and anchor lines for securing the canopy against strong winds; and a storage bag for conveniently carrying the collapsed canopy, collapsed canopy shade, stakes and lines.

6. The shade device according to claim 5 wherein said rods are formed of fiberglass.

7. The shade device according to claim 5, further including:

first and second double sided hook and loop fastening arm connection straps;

said first connection strap is attached to said first frame rod at said first frame support opening and said second connection strap is attached to said frame at said second frame support opening.

8. The shade device according to claim 7, further including:

a first elastic restraining strap attached to said canopy and a second elastic restraining strap attached to said canopy shade, said straps securing said canopy and said canopy shade in a collapsed position.

9. The shade device according to claim 8, further including:

a front edge opening and a rear edge opening on said top section of said canopy, said front and rear edge openings permitting said flexible frame to be grasped and manipulated to collapse said canopy.

10. The shade device according to claim 9, further including:

a pair of web straps having quick release buckles secured onto the outer surface of said rear section of said canopy.

11. The shade device according to claim 5, further including:

a first ventilation window formed in said first side section;

a second ventilation window formed in said second side section; and a third ventilation window formed in said rear section;

wherein said ventilation windows include a flexible mesh material.

12. The shade device according to claim 11, wherein said flexible mesh material is mosquito netting and further including:

a pair of tie-down loops stitched adjacent to a front edge of said top section of said canopy to provide tie downs points for said anchor lines.

13. The shade device of claim 5, further including;

a self-erecting and collapsible canopy shade removably attachable to said canopy;

said canopy shade is provided in the form of a generally round shade body formed mosquito netting having a shade frame channel stitched along the periphery of said shade body and a flexible rod placed in said frame channel with the ends of said rod secured together by a ferrule; and a pair of elastic straps stitched along the edge of said body having suspender clips attached to a distal end thereof.

* * * * *